US012501995B2

(12) United States Patent
Barrett et al.

(10) Patent No.: US 12,501,995 B2
(45) Date of Patent: Dec. 23, 2025

(54) MODULAR TABLE LEG ASSEMBLY

(71) Applicant: KRUEGER INTERNATIONAL, INC., Green Bay, WI (US)

(72) Inventors: Shawn Barrett, Libertyville, IL (US); Scott J. Williams, Green Bay, WI (US); Matthew Gordon Gleason, Green Bay, WI (US); Robert John Claus, Green Bay, WI (US)

(73) Assignee: KRUEGER INTERNATIONAL, INC., Green Bay, WI (US)

( * ) Notice: Subject to any disclaimer, the term of this patent is extended or adjusted under 35 U.S.C. 154(b) by 171 days.

(21) Appl. No.: 18/439,019

(22) Filed: Feb. 12, 2024

(65) Prior Publication Data

US 2025/0255407 A1 Aug. 14, 2025

(51) Int. Cl.
*A47B 9/20* (2006.01)
*A47B 9/10* (2006.01)

(52) U.S. Cl.
CPC . *A47B 9/20* (2013.01); *A47B 9/10* (2013.01)

(58) Field of Classification Search
CPC .. A47B 9/20; A47B 9/10; A47B 13/02; A47B 2200/0051
See application file for complete search history.

(56) References Cited

U.S. PATENT DOCUMENTS 5,553,550 A 9/1996 Doyle
5,758,586 A * 6/1998 Kieser ..... A47B 9/00 108/147
6,189,843 B1 * 2/2001 Pfister ..... A47B 9/083 248/161
6,327,985 B1 * 12/2001 Frenkler ..... A47B 9/00 248/188.4
6,360,675 B1 3/2002 Jones
6,711,985 B1 3/2004 Doyle
7,806,384 B2 * 10/2010 Doyle ..... B66F 1/08 108/50.02
11,497,304 B1 * 11/2022 Pan ..... A47B 9/10
2002/0102034 A1 8/2002 Holdredge
2018/0092457 A1 * 4/2018 Lai ..... A47B 9/20
2019/0174913 A1 * 6/2019 Lin ..... A47B 9/20
2021/0186207 A1 * 6/2021 Heyring ..... A47B 13/02
2022/0053925 A1 * 2/2022 Hung ..... A47B 23/00
(Continued)

FOREIGN PATENT DOCUMENTS

CN 207979267 U 10/2018
CN 209090205 U 7/2019
(Continued)

*Primary Examiner* — Daniel J Rohrhoff
(74) *Attorney, Agent, or Firm* — Andrus Intellectual Property Law, LLP

(57) ABSTRACT

A table leg assembly for use with either a fixed height table or an adjustable height table. The table leg assembly includes a foot casting that includes at least a pair of legs extending from the body portion of the foot casting. In an adjustable height table, an outer leg column is attached above the foot casting and a leg column extension is attached below the foot casting. An inner leg column is movable by a drive cylinder to adjust the height of the table. The table top is attached to and moves with the inner leg column. In a fixed height table, the leg column extension is eliminated, and the same foot casting and outer leg column define the table leg assembly.

18 Claims, 11 Drawing Sheets

(56) References Cited

U.S. PATENT DOCUMENTS

| | | | | |
|---|---|---|---|---|
| 2024/0057762 | A1* | 2/2024 | Höglund | A47B 9/04 |
| 2025/0288093 | A1* | 9/2025 | Clinard | A47B 9/04 |

FOREIGN PATENT DOCUMENTS

| | | | | |
|---|---|---|---|---|
| CN | 113317617 | A * | 8/2021 | A47B 13/003 |
| DE | 10017636 | A1 | 10/2000 | |
| DE | 102005007363 | B4 | 11/2006 | |

* cited by examiner

MODULAR TABLE LEG ASSEMBLY

BACKGROUND

The present disclosure generally relates to a modular table leg assembly that can be used with either a fixed height table or an adjustable height table. More specifically, the present disclosure is directed to a table leg assembly that includes a common foot casting and outer leg column that are used with both a fixed and adjustable height table.

Many furniture manufacturers offer various different types of tables to fit the needs of specific customers. As an example, furniture manufacturers may offer a line of tables that have the same overall appearance but can be ordered as a simple, fixed height table, an adjustable height table, a fixed height nesting table in which the table top transitions from a horizontal use position to a nearly vertical storage position and a static height nesting table. Each of these four different variations in the table line can require slightly different components to create the required table legs for the specific table. In such situation, the furniture manufacturer much maintain inventory of a number of table specific parts so that the selected table can be assembled when ordered.

The inventors of the present disclosure have recognized the problems associated with maintaining an inventory of multiple parts to form the different table types and have thus created a modular design for the table leg assembly. The modular table leg design of the present disclosure reduces the number of parts that must be kept in inventory while allowing for the configuration of the table leg assembly for use with multiple table types.

SUMMARY

The present disclosure relates to a modular table leg assembly that can be used with multiple different table types. The modular table leg assembly design of the present disclosure reduces the number of parts that must be maintained in inventory while allowing for the creation of fixed height and adjustable height tables that may include nesting or static table tops.

The table leg assembly of the present disclosure is designed to provide support for a table top. The table leg assembly includes a foot casting that is a common component for either a fixed height table or an adjustable height table. The foot casting is cast from a durable metallic material, such as aluminum. The foot casting includes a central body portion and at least a pair of legs that extend from the body portion. The body portion is formed from an outer wall that defines an open interior and at least a pair of attachment channels that extend through the entire height of the foot casting.

The table leg assembly further includes an outer leg column that is shaped and formed to be received on an upper end of the foot casting. The outer leg column is aligned with the foot casting such that attachment channels in the outer leg column are aligned with the attachment channels in the body portion of the foot casting. If the table leg assembly is to be used with an adjustable height table, a leg column extension is positioned below the foot casting. The leg column extension has generally the same profile as the outer leg column and includes an open interior and a pair of attachment channels. The attachment channels of the leg column extension are aligned with the attachment channels of the foot casting.

Once the table leg assembly is configured to include the leg column extension for an adjustable table or without the leg column in a fixed height table design, at least a pair of draw bolts are used to secure the modular components together to create the table leg assembly. In the design of the present disclosure, the same foot casting and outer leg column are used across all of the possible table configurations, thereby reducing the number of parts needed and reducing the cost to the table manufacturer.

In an adjustable height table design, an adjustment cylinder is seated within a bottom cap mounted to the leg column extension. Since the leg column extension extends below the foot casting, the leg column extension increases the possible length of the adjustment cylinder and thus increases the amount of extension for an internal cylinder rod of the adjustment cylinder. The cylinder rod is connected to an inner leg column that can be extended and retracted within the outer leg column. The inner leg column is coupled to the table top such that the table top moves with the movement of the inner leg column.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
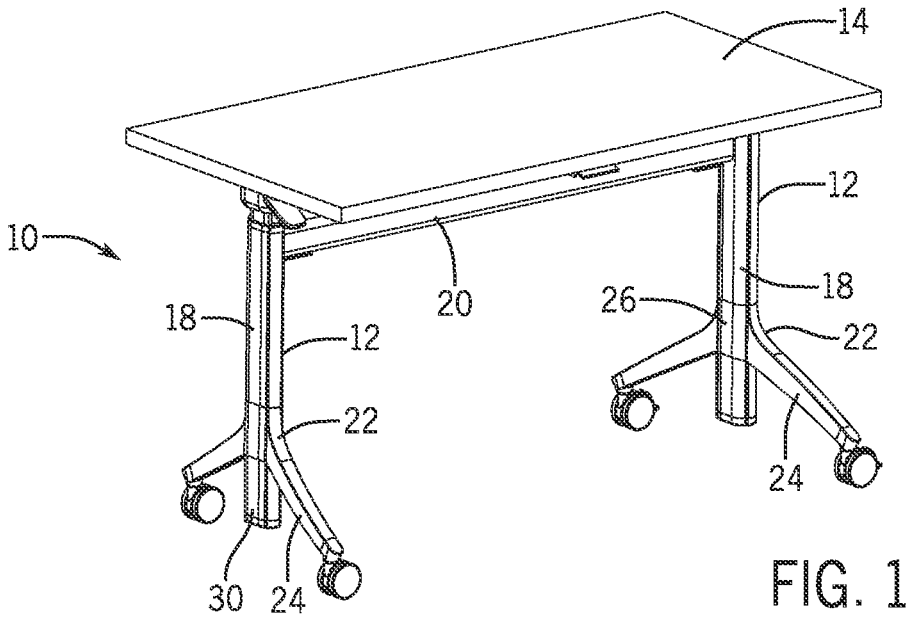
FIG. 1 is a perspective view of an adjustable height table including the modular table leg assembly of the present disclosure.
Figure 2:
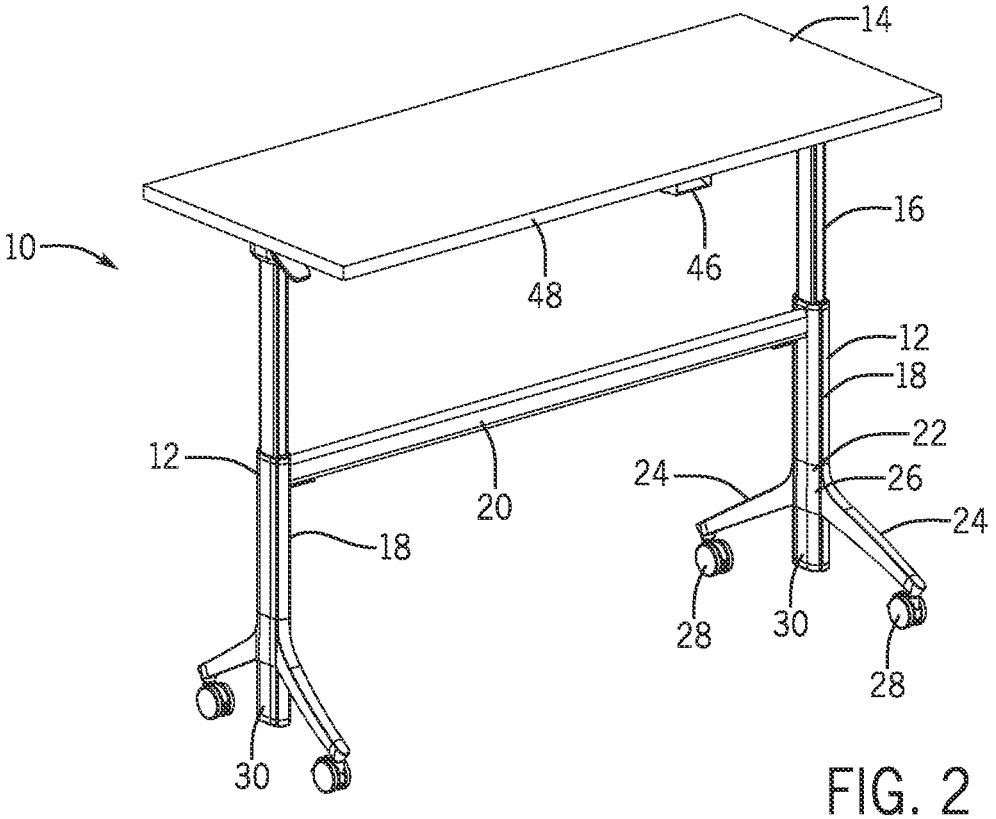
FIG. 2 is a perspective view similar to FIG. 1 showing the adjustable height table in the fully raised position.
Figure 4:
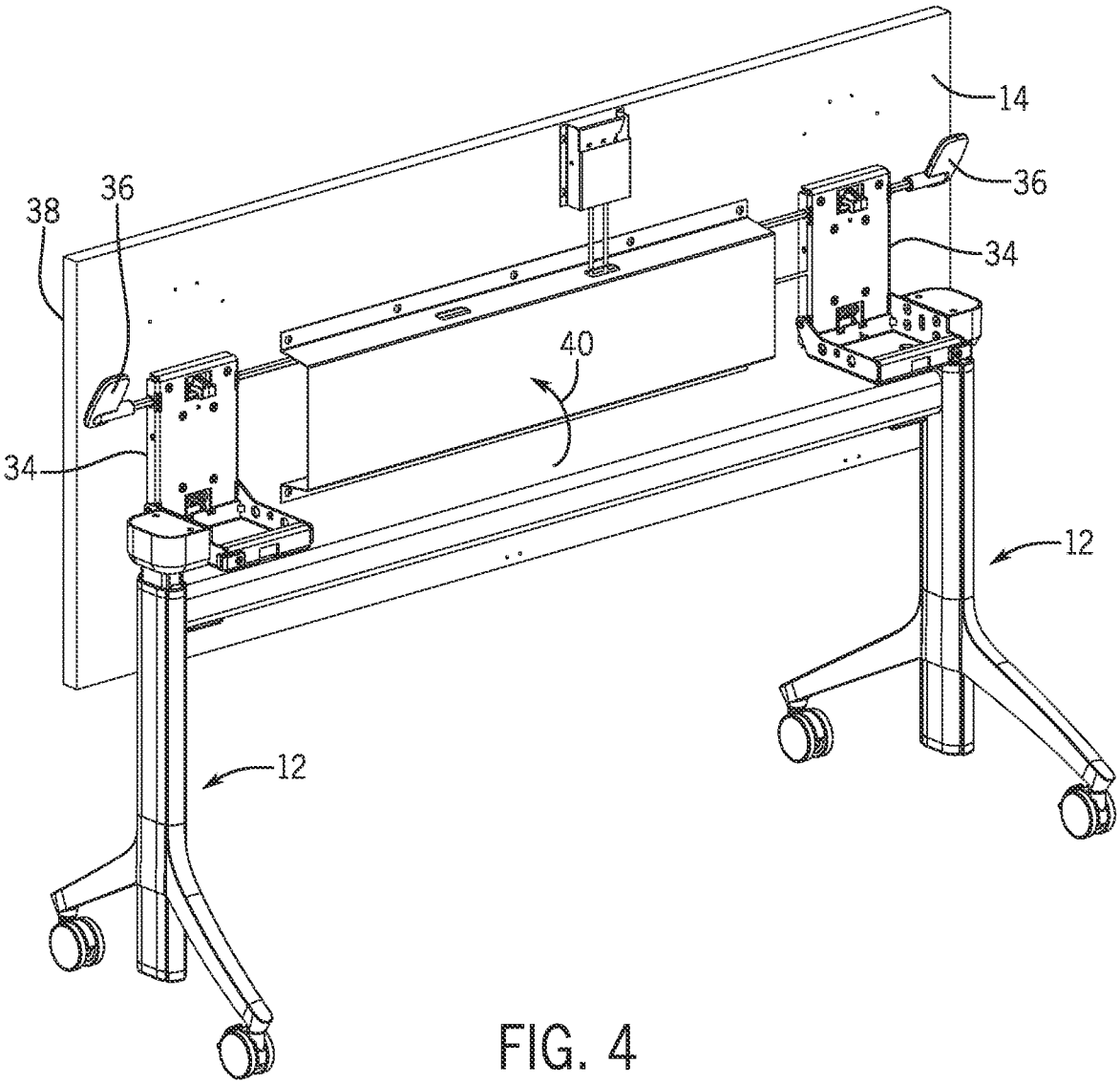
FIG. 4 is a perspective view showing the transition of the adjustable height table to a storage position.

FIGS. 1 and 2 illustrate a height adjustable table 10 constructed utilizing the modular table leg assembly 12 of the present disclosure. The height adjustable table 10 includes a table top 14 that is adjustable between a fully lowered position shown in FIG. 1 and a fully raised position shown in FIG. 2. The table top 14 is supported above a floor surface by a pair of modular table leg assemblies 12. In the embodiment shown in FIGS. 1 and 2, each of the table leg assemblies 12 includes an inner leg column 16 that is extendable and retractable into and out of a stationary outer leg column 18 such that the height of the table top 14 from a floor surface can be modified. In the embodiment shown in FIGS. 1 and 2, the table top 14 is also pivotable from a use position shown in FIGS. 1 and 2 to a nearly vertical storage position as best shown in FIG. 4. The pivoting movement of the table top to the storage position allows multiple tables 10 to nest with each other in the storage position to reduce the amount of space needed to store the multiple tables when not in use. Although the adjustable height table 10 in the embodiment shown in FIGS. 1 and 2 is pivotable to the storage position, it should be understood that the table top 14 could be fixed in the horizontal use position of FIGS. 1 and 2 while operating within the scope of the present disclosure.

As shown in FIGS. 1 and 2, the pair of table leg assemblies 12 are joined to each other by a cross support 20 that extends between the pair of outer leg columns 18. The cross support 20 provides the desired spacing and support for each of the two table leg assemblies 12.

In the embodiment shown in FIGS. 1 and 2, each of the table leg assemblies 12 further includes a foot casting 22. The foot casting 22 includes a pair of legs 24 that each extend from a center body portion 26. Each of the legs 24 includes a caster wheel 28 that allow the entire height adjustable table 10 to be moved along a floor surface.

In the height adjustable table 10 shown in FIGS. 1 and 2, the table leg assembly 12 further includes a leg column extension 30 that extends below the body portion 26 of the foot casting 22. Each leg column extension 30 provides an extension of the leg column below the body portion 26 of the foot casting 22. The leg column extension 30 is used to increase the possible length of the inner leg column 16 to thereby increase the amount of upward movement of the table top 14.

Figure 3C:
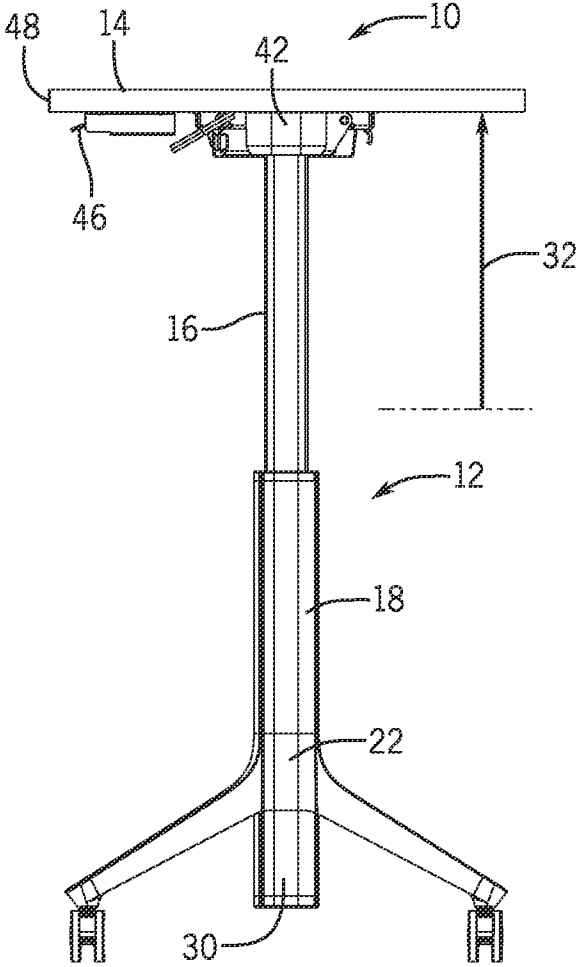
FIG. 3C is a side view showing the adjustable height table in the fully raised position.
Figure 3B:
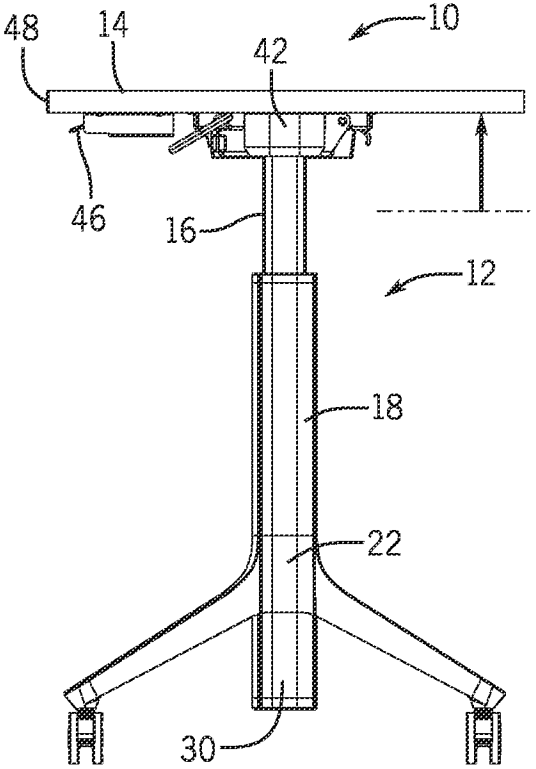
FIG. 3B is a side view showing the adjustable height table in a mid-height position.
Figure 3A:
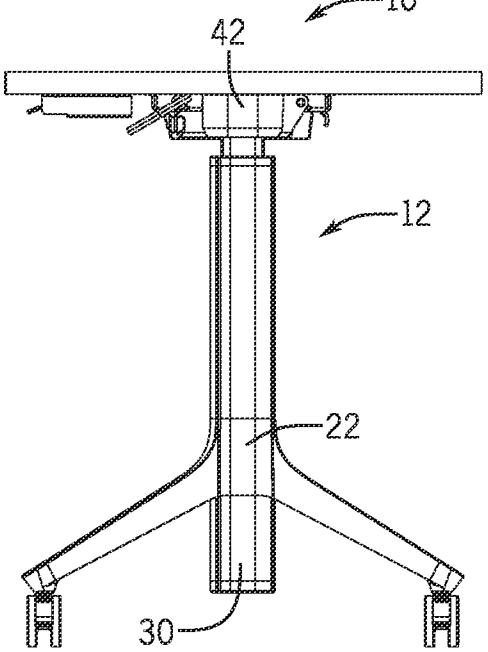
FIG. 3A is a side view showing the adjustable height table in the fully lowered position.

FIGS. 3A-3C illustrate the movement of the height adjustable table 10 from the fully lowered position shown in FIG. 3A to the fully raised position shown in FIG. 3C. During this movement, the inner leg column 16 is moved upward out of the outer leg column 18 by an inner cylinder drive mechanism that will described in greater detail below. Since the leg column extension 30 is shown mounted to the foot casting 22, the amount of vertically upward movement of the table top 14 is increased as compared to a table leg assembly 12 that does not include the leg column extension 30. In the image of FIG. 3C, the amount of vertical movement is illustrated by arrow 32. This amount of vertical movement is greater than an embodiment in which the table leg assembly 12 does not include the leg column extension 30.

FIG. 4 illustrates the pivoting movement of the table top 14 from the generally horizontal operating position shown in FIG. 1 to a nearly vertical, storage and nesting position of FIG. 4. The nesting height adjustable table 10 includes a pair of pivot assemblies 34 that are used to pivotally mount the generally planar table top 14 to the top end of each of the table leg assemblies 12. Each of the pivot assemblies 34 includes a release handle 36 that extends to the outer edge 38 of the table top such that a user can grasp either one or both of the release handles 36 to release the pivoting mechanism included in the pivot assemblies 34. When the release handles 36 are engaged, the user is able to pivot the table top to the nesting position, as shown by arrow 40 in FIG. 4.

Figure 5:
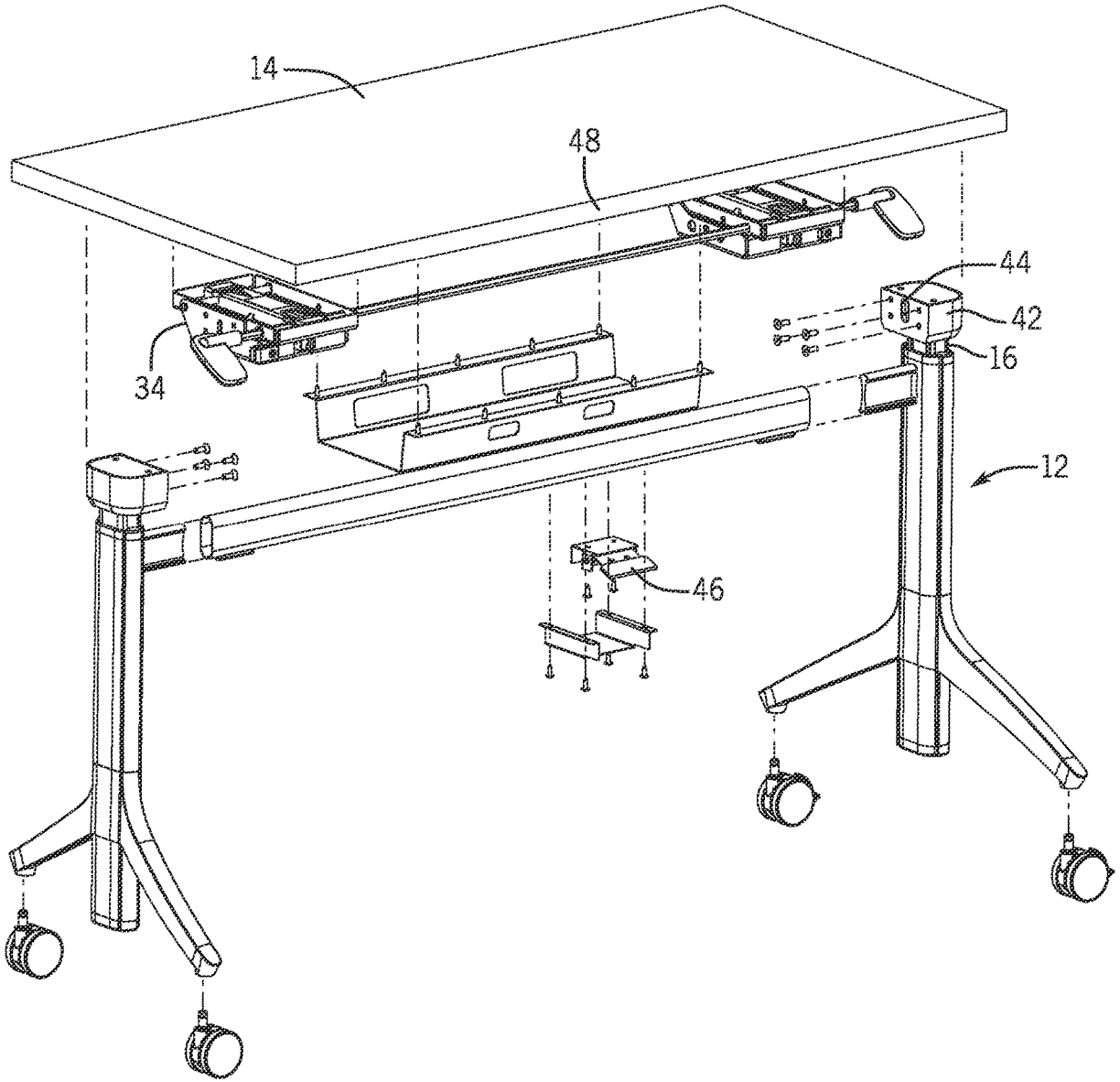
FIG. 5 is a partially exploded view showing the components of a nesting table with adjustable legs.

Referring now to FIG. 5, each of the table leg assemblies 12 further includes a mounting head 42 that is attached to the top end of the inner leg column 16. The mounting head 42 provides a point of attachment for each of the pivot assemblies 34 and provides access to the operating and drive components contained within the table leg assembly 12. The mounting head 42 moves along with the upward and downward movement of the inner leg column 16, as can be seen in the side views of FIGS. 3A-3C. In addition, the mounting head 42 provides a cable passageway 44 that allows one end of a release cable to enter into the open interior defined by the table leg assembly 12. The operating cable is connected to a activation handle 46 which is positioned below and slightly recessed from the front edge 48 of the table top 14. Thus, when a user desires to raise or lower the height of the table top 14, the user can grasp the activation handle 46 and lift up or push down on the table top 14 to adjust the height. Once the desired height has been achieved, the activation handle 46 is released by the user and the table top 14 assumes the desired position.

Figure 6:
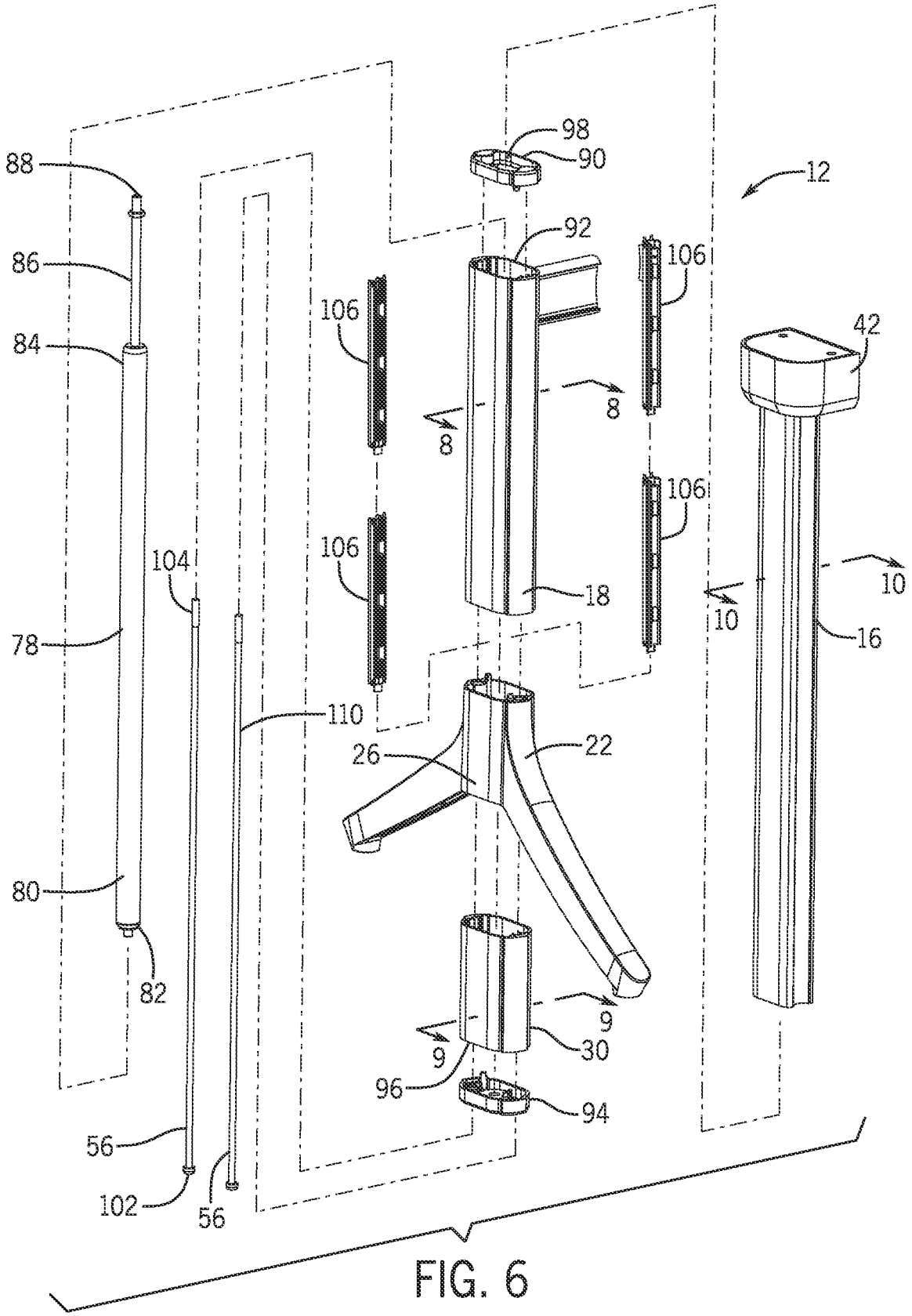
FIG. 6 is an exploded view of the table leg assembly for an adjustable height table in accordance with the present disclosure.
Figure 7:
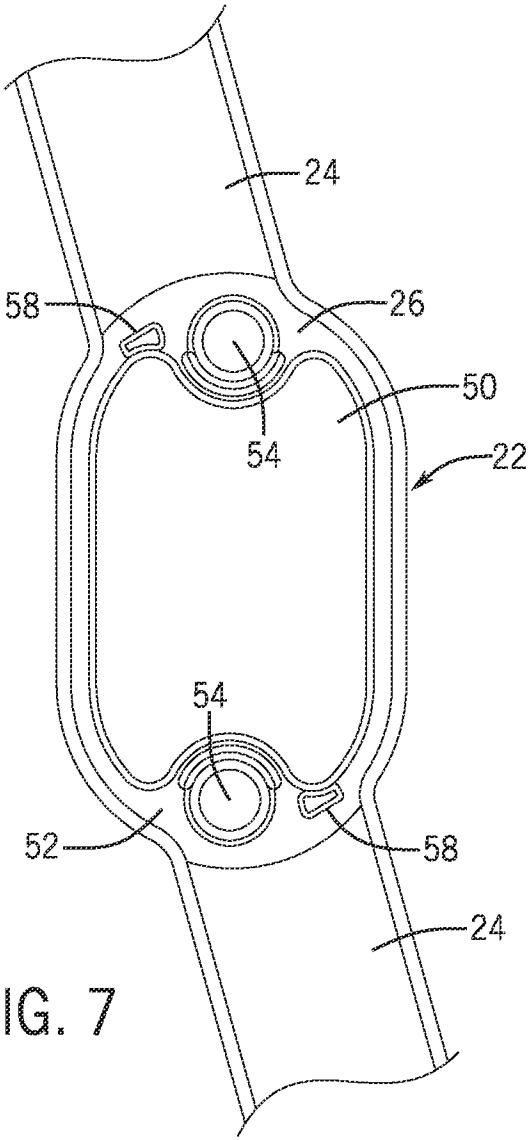
FIG. 7 is a top view of the foot casting that forms part of the table leg assembly.

FIGS. 6 and 7 illustrate the operating components of the table leg assembly 12 when the table leg assembly 12 is used with a height adjustable table. As described previously, the table leg assembly 12 includes an outer leg column 18, a foot casting 22 and a leg column extension 30. As illustrated in FIG. 3, each of these components has a generally consistent outer profile such that when the outer leg column 18, the foot casting 22 and the lower leg column extension 30 are assembled, the entire table leg assembly 12 has a consistent and visually pleasing appearance.

FIG. 7 is a top view of the foot casting 22. As described previously, the foot casting 22 includes a body portion 26 and a pair of legs 24. The body portion 26 defines an open center portion 50 that is sized to allow the inner leg column 16 to move into and out of the body portion 26. On either side of the open center portion is a section of the extruded wall 52 that defines one two attachment channels 54. The attachment channels 54 extend the entire length of the body portion 26 and allow one of a pair of draw bolts 56 to pass through the entire height of the foot casting 22, as will be described below and as shown in the section view of FIG. 11. The top end of the body portion 26 includes a pair of alignment tabs 58 that help to align the outer leg column 18 with the foot casting 22 during assembly. In the embodiment shown, the entire foot casting 22 is formed from a cast aluminum material, although other materials are contemplated.

Figure 8:
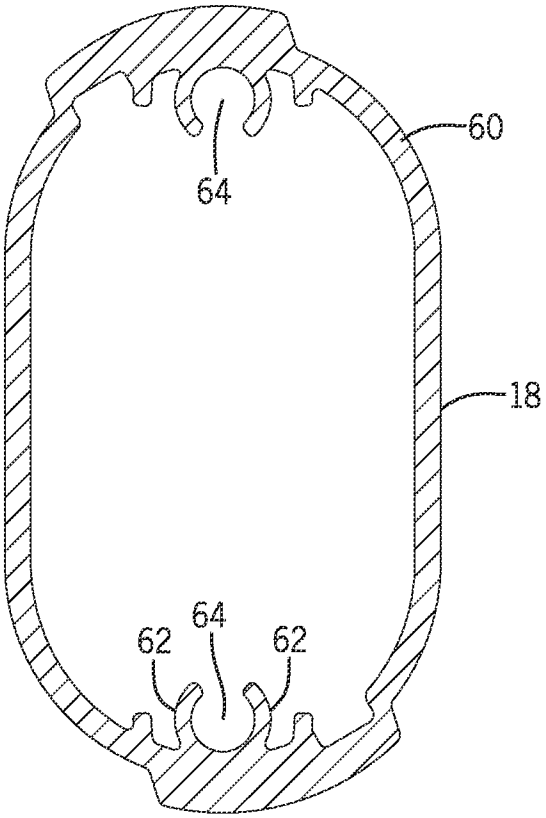
FIG. 8 is a section view taken along line 8-8 of FIG. 6.

FIG. 8 is a section view of the outer leg column 18. The outer leg column 18 is defined by an outer wall 60 that includes a pair of extending fingers 62 on each side. The fingers 62 define an attachment channel 64 that will be vertically aligned with the attachment channels 54 in the foot casting 22 when the two components are assembled as shown in FIG. 6. In the embodiment shown in FIG. 8, the entire outer leg column 18 is formed from an extruded metallic material, such as aluminum.

Figure 9:
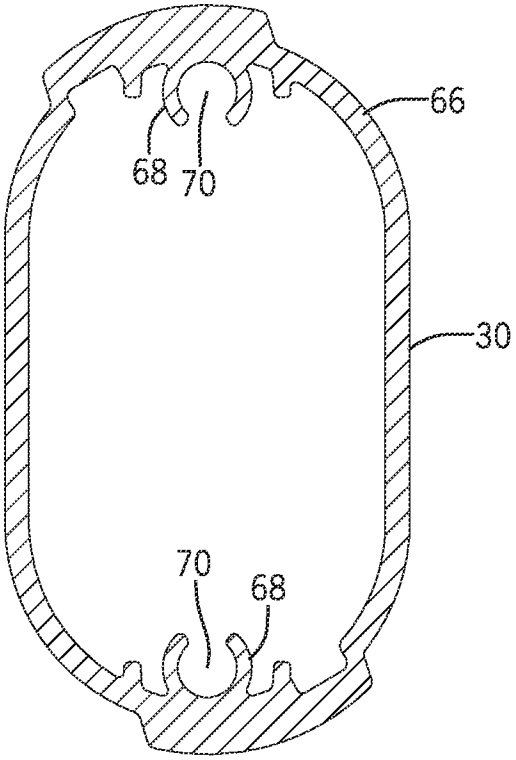
FIG. 9 is a section view taken along line 9-9 of FIG. 6.

FIG. 9 is a section view through the lower column extension 30. As can be seen in a comparison between FIGS. 8 and 9, the cross-sectional appearance of the lower leg column extension 30 and the outer leg column 18 are nearly identical. The leg column extension 30 is formed from an outer wall 66 that includes similar fingers 68 that define an attachment channel 70. Thus, when the leg column extension 30 is positioned below the body portion 26 of the foot casting 22 as shown in FIG. 6, the attachment channels 70 are vertically aligned with the attachment channels 54 formed in the body portion 26.

Figure 10:
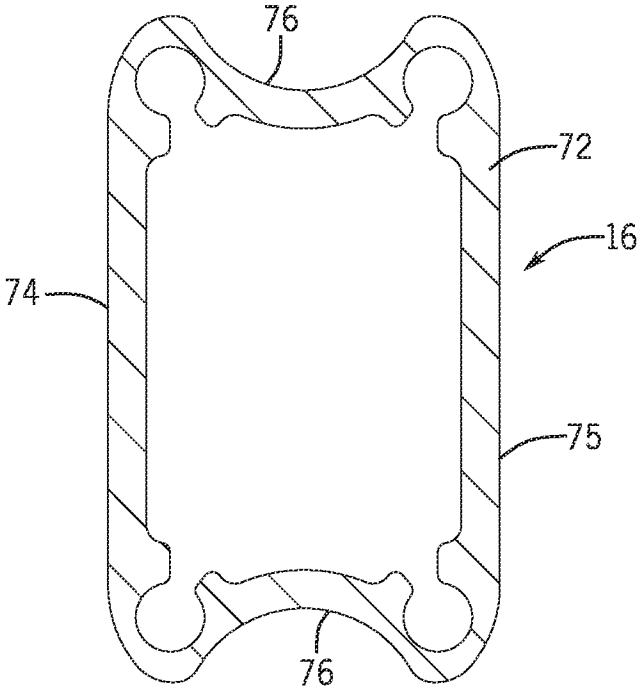
FIG. 10 is a section view taken alone line 10-10 of FIG. 6.

FIG. 10 is a section view taken through the inner leg column 16 shown in FIG. 6. The section view of the inner leg column 16 illustrates that the inner leg column 16 is formed from an extruded outer wall 72 that defines a generally flat outer surface 74 and a curved inner surface 75. The outer surface 74 is visible to the exterior of the table while the curved inner surface 74 faces the interior of the table. The inner leg column includes a pair of curved, recessed surfaces 76 that provide clearance for the draw bolts 56 and a secure contact surface for the glide elements 106 shown in FIGS. 6 and 11 such that the inner leg column 16 is freely movable into and out of the combination of the outer leg column 18, the foot casting 22 and the column extension 30, along the glide elements 106.

Referring back to FIG. 6, when the modular table leg assembly 12 is used with the adjustable height table, the assembly further includes an adjustment cylinder 78. The adjustment cylinder 78 is an air cylinder that includes a cylinder body 80 that extends from a bottom end 82 to a top end 84. The adjustment cylinder 78 includes an extendable cylinder rod 86 that can be retracted and extended from the cylinder body 80 through the release of internal air pressure, as is well known. The cylinder rod 86 includes a top end 88 that is securely connected to the mounting head 42 attached to the top end of the inner leg column 16. In this manner, when the cylinder rod 86 is extended into and out of the cylinder body 80, the cylinder rod 86 will cause the movement of the inner leg column 16 into and out of the outer leg column 18 and foot casting 22, along the glide elements 106.

In the embodiment shown in FIG. 6, the table leg assembly 12 further includes a top cap 90 mounted to a top end 92 of the outer leg column and a bottom cap 94 mounted to the bottom end 96 of the leg column extension 30. The top cap 90 includes a center opening 98 that allows the cylinder rod 86 to extend through the top cap 90 during the movement of the inner leg column 16. The bottom cap 94 provides a point of attachment and mounting for the bottom end 82 of the cylinder body 80.

Figure 11:
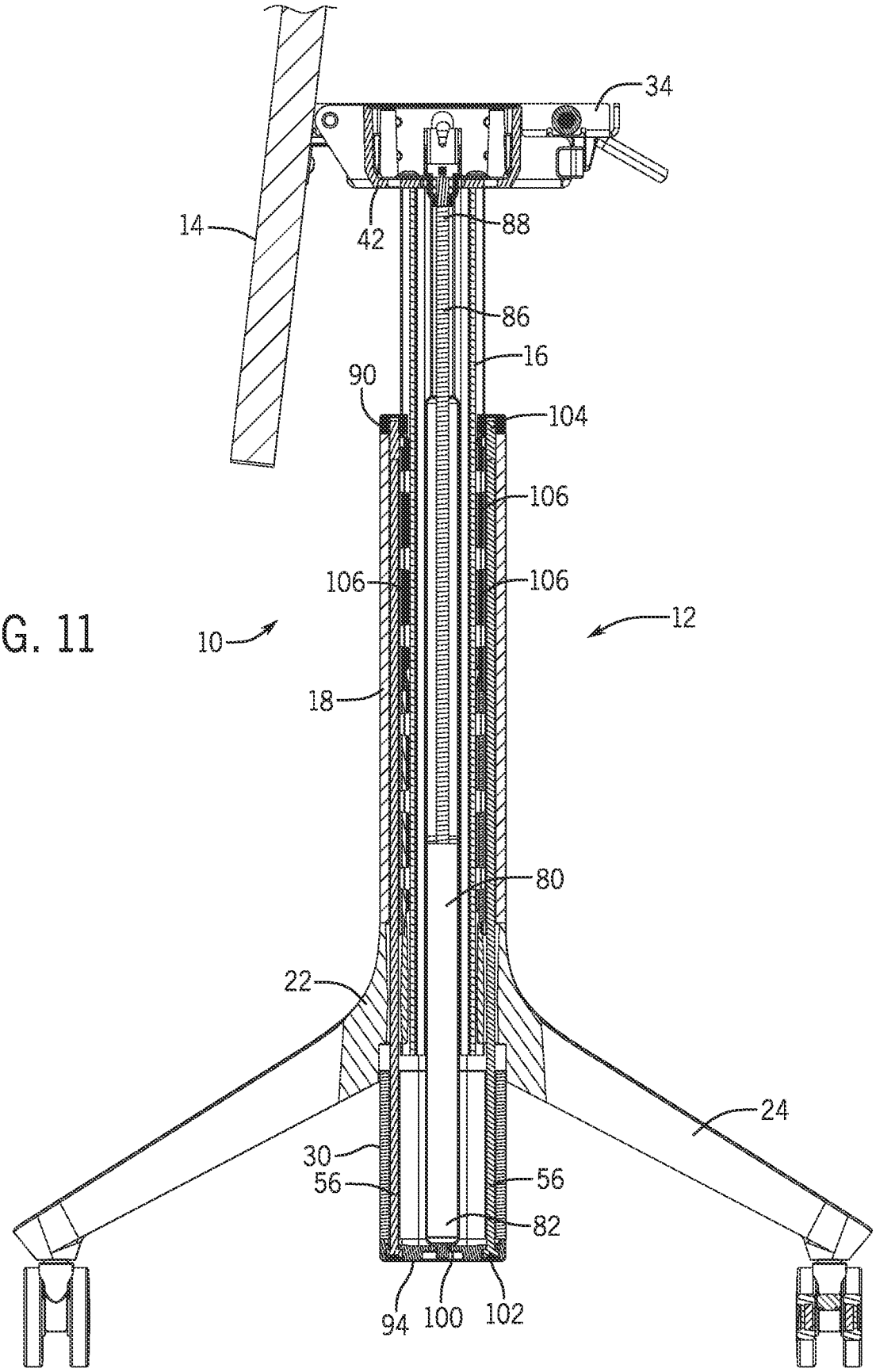
FIG. 11 is a vertical section view of the table leg assembly for an adjustable height table.

FIG. 11 is a section view of the assembled table leg assembly 12 when used with the adjustable height table 10. As can be seen in this view, the bottom end 82 of the cylinder body 80 is received within an alignment slot 100 formed in the bottom cap 94. The alignment slot 100 accurately locates the cylinder body 80 and prevents lateral movement of the cylinder body 80. When the table leg assembly 12 is in the assembled condition, the pair of draw bolts 56 extend through the entire structure to securely hold the table leg assembly in the assembled condition. Each of the draw bolts 56 includes an expanded head 102 that engages with and is received in the bottom cap 94. The draw bolts 56 extend through the attachment channel 70 (FIG. 9) in the leg column extension 30 and into the corresponding attachment channels 54 (FIG. 7) formed in the body portion 26 of the foot casting 22. Each of the draw bolts 56 further extends into the outer leg column 18 and are received within the attachment channels 64 (FIG. 8). Finally, the threaded outer end portion 104 of each draw bolt 56 is received within internally threaded openings formed in the top cap 90. In this manner, the draw bolts 56 create a secure connection between the leg column extension 30, the foot casting 22 and the outer leg column 18.

The top end 88 of the cylinder rod 86 is securely attached to the bottom wall of the mounting head 42. Thus, as the cylinder rod 86 is extended, the mounting head 42 and the attached pivot 34 moves vertically to adjust the vertical position of the table top 14. The mounting head 42 is securely connected to the inner leg column 16 such that the inner leg column 16 and the mounting head 42 move along with the extension and retraction of the cylinder rod 86 into and out of the cylinder body 80.

As shown in FIG. 11, a series of guide elements 106 are mounted along the inner wall of the outer leg column 18. The series of guide elements provide a guide surface during the vertical movement of the inner leg column 16. The guide elements 106 are formed from a resilient plastic material, such as but not limited to Delrin®. Referring back to FIG. 6, each of the draw bolts 56 includes the expanded head 102 on one end and the threaded portion 104 on the opposite end. The threaded portion 104 is received within the top cap 90. The remaining portions of the body 110 of the draw bolts 56 are unthreaded such that the draw bolts can pass through the components of the assembled table leg assembly 12.

Figure 12:
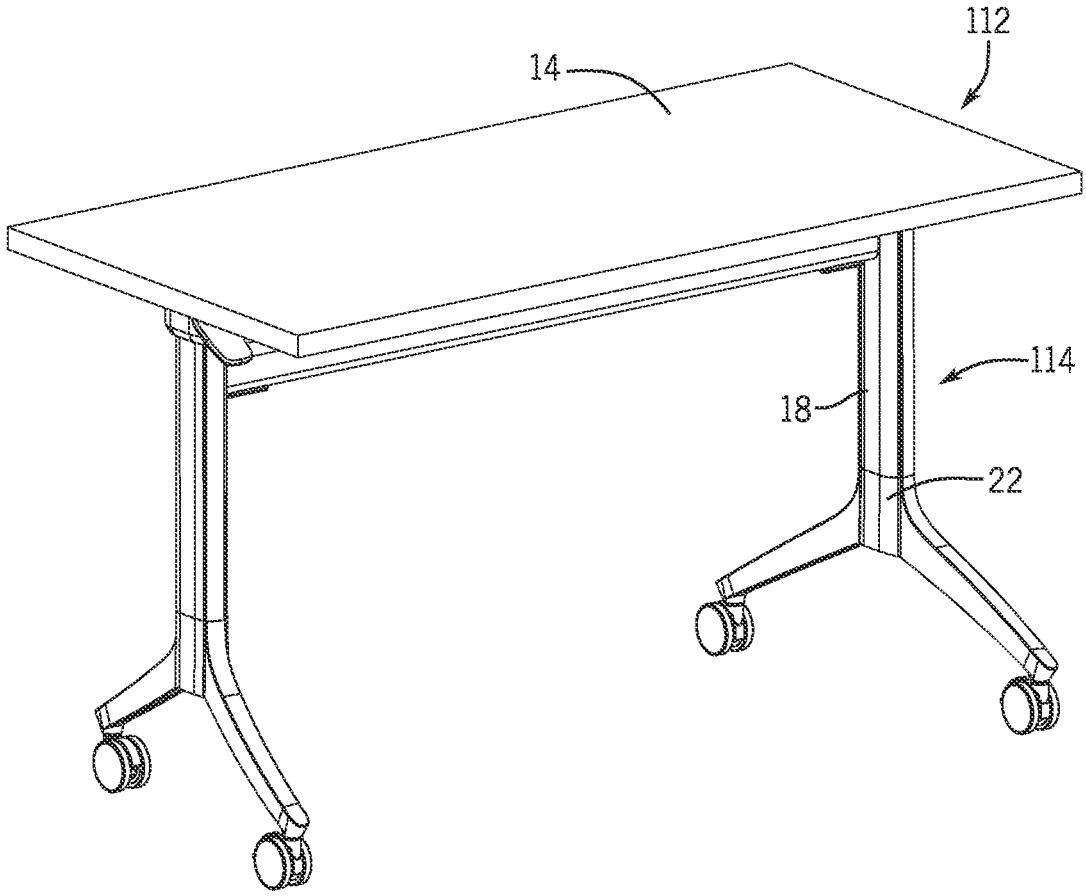
FIG. 12 is a perspective view of a fixed height table including the modular table leg assembly of the present disclosure.
Figure 13B:
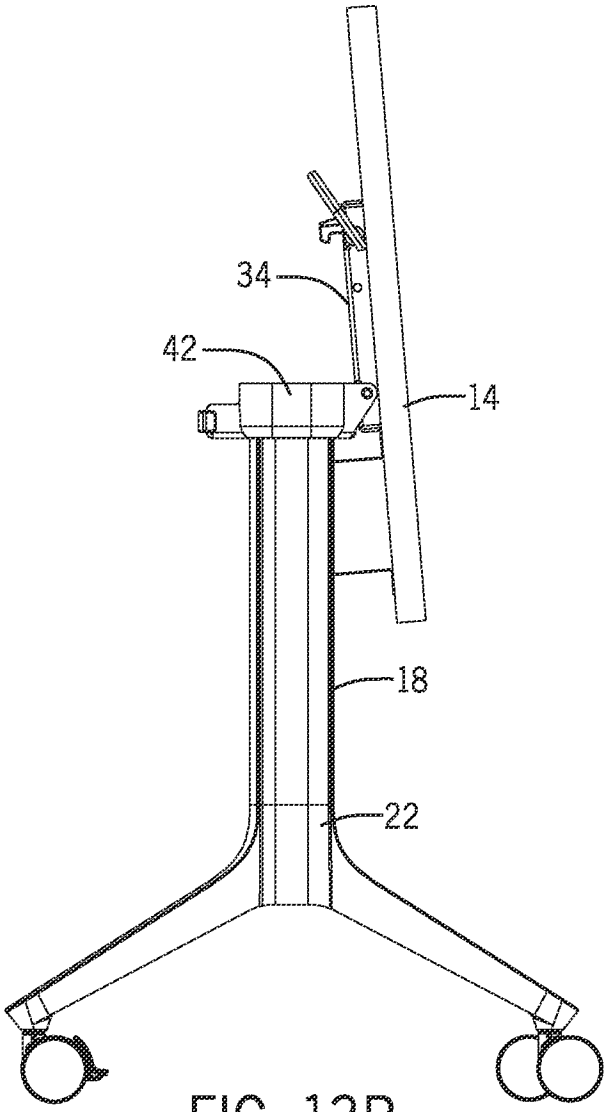
FIG. 13B is a side view showing the pivoting movement of the table top.
Figure 13A:
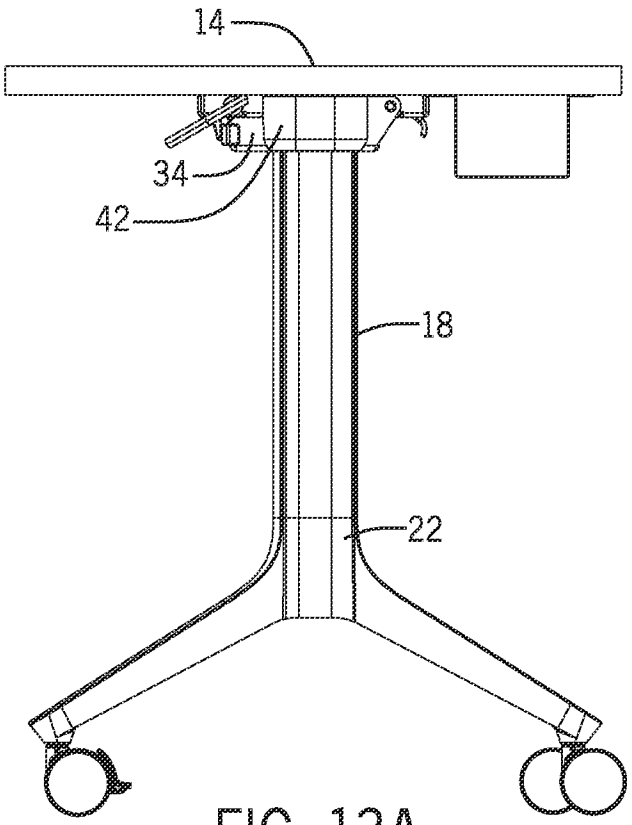
FIG. 13A is a side view showing the fixed height table.

FIG. 12 illustrates another embodiment of a type of table that can be assembled using the table leg assembly of the present disclosure. In the embodiment of FIG. 12, the table is shown as a fixed height table 112 that utilizes the table leg assembly 114 of the present disclosure. The table leg assembly 114 uses many of the same components as the table leg assembly 12 shown in the previous figures. However, the table leg assembly 114 is designed to be used with a fixed height table 112 and thus does not include the adjustment cylinder and the extendable inner leg column. Since the adjustment cylinder is removed in the fixed height table 112, the table leg assembly 114 also does not need to include the lower leg column extension shown in the previous figures. Instead, the foot casting 22 is used with only the outer leg column 18. Since the height of the table top 14 is fixed, the entire vertical adjustment mechanism, including the drive cylinder and the inner leg column can be eliminated. As shown in the FIGS. 13A and 13B, the outer leg column 18 is connected directly to the mounting head 42. As in the previous embodiments, the mounting head 42 provides support for the pivot assemblies 34, which allow the table top 14 to pivot from the horizontal use position of FIG. 13A to the generally vertical storage and nesting position of FIG. 13B.

Figure 14:
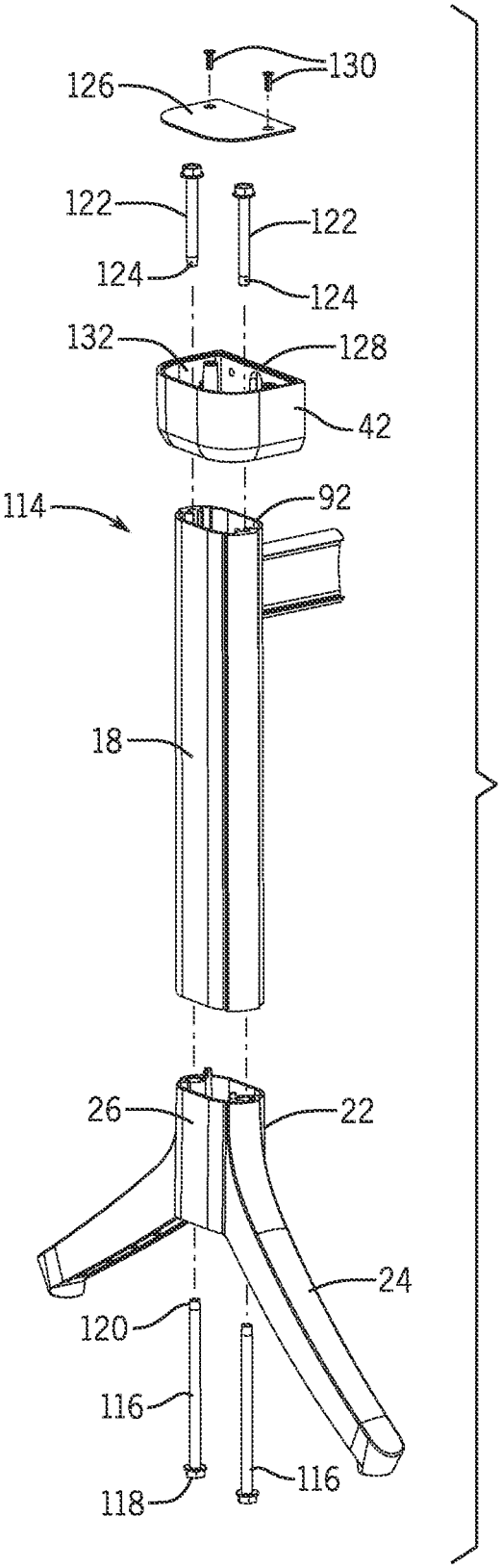
FIG. 14 is an exploded view of the table leg assembly for the fixed height table.

As shown in the exploded view of FIG. 14, the table leg assembly 114 includes the outer leg column 18 mounted directly to the body portion 26 of the foot casting 22. The outer leg column 18 is secured to the body portion 26 by a pair of lower draw bolts 116. The lower draw bolts 116 include the expanded head portion 118 and a threaded upper end 120. The threaded upper end 120 is received within the body of the outer leg column 18 to securely attach the outer leg column 18 to the foot casting 22. The top end 92 of the outer leg column 18 is received within the head 42. A pair of upper draw bolts 122 extend through the head 142 such that the threaded outer end 124 of each of the upper draw bolts 122 is received and retained within the interior of the outer leg column 18. A cover plate 126 is secured to the top end 128 of the head 42 by a series of threaded connectors 130. The cover plate 126 thus encloses the open interior 132 of the head 42.

As can be understood in the above description, the table leg assembly of the present disclosure can be used in a table that either has a fixed height or has an adjustable height through the operation of an internally located adjustment cylinder. In both embodiments, the table leg assembly includes a common outer leg column 18 and a foot casting 22. In the adjustable height table leg assembly, a lower leg column extension 30 can be utilized to increase the amount the table top 14 can be extended from the foot casting 22. Since the foot casting 22 and the outer leg column 18 are common between both a fixed height table and an adjustable height table, fewer components need to be inventoried when assembling the two different types of tables. The use of the additional extension below the foot casting also allows for different amounts of table height adjustment depending upon user requirements. a This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A table leg assembly for supporting a table top, the table leg assembly comprising:

a foot casting including at least a pair of legs extending from a body portion;

an outer leg column supported on the foot casting, the outer leg column being supported on the body portion of the foot casting; and a leg column extension selectively positionable below the body portion of the foot casting, wherein the leg column extension is coupled to the body portion of the foot casting to extend the outer leg column and is selectively removable from the foot casting.

2. The table leg assembly of claim 1 further comprising a pair of draw bolts extending through the foot casting and the outer leg column to secure the foot casting and the outer leg column to each other.

3. The table leg assembly of claim 2 wherein the pair of draw bolts extend through the leg column extension to secure the bottom leg column, the outer leg column and the foot casting together when the bottom leg column extension is positioned below the foot casting.

4. The table leg assembly of claim 3 further comprising a top cap mounted to an upper end of the outer leg column and a bottom cap mounted to the bottom leg column extension, wherein the pair of draw bolts extend between the top cap and the bottom cap.

5. The table leg assembly of claim 1 further comprising an adjustable leg column that extends through the outer leg column and the foot casting and is received in the leg column extension when the bottom leg column extension is positioned below the foot casting, wherein the adjustable leg column is movable out of the outer leg column to move the table top.

6. The table leg assembly of claim 5 further comprising an adjustment cylinder having a cylinder body and an extendable cylinder rod, wherein a bottom end of the cylinder body is received in the leg column extension and a top end of the cylinder rod is coupled to the adjustable leg column.

7. The table leg assembly of claim 6 further comprising a bottom cap coupled to the leg column extension, wherein the bottom end of the cylinder body is supported by the bottom cap.

8. The table leg assembly of claim 2 wherein the foot casting and the outer leg column each include a pair of internal passageways that are aligned with each other to receive the pair of draw bolts.

9. The table leg assembly of claim 1 wherein the bottom leg column extension is selectively removed in a first embodiment in which the height of the table top is fixed and utilized when the height of the table top is adjustable.

10. A table, comprising:

a table top; and a pair of table leg assemblies for supporting a table top, each of the table leg assemblies comprising:

a foot casting including at least a pair of legs extending from a body portion;

an outer leg column supported on the foot casting, the outer leg column being supported on the body portion of the foot casting; and a bottom leg column extension selectively positionable below the body portion of the foot casting, wherein the bottom leg column is coupled to the body portion of the foot casting to extend the outer leg column and is selectively removable from the foot casting.

11. The table of claim 10 further comprising a pair of draw bolts extending through the foot casting and the outer leg column to secure the foot casting and the outer leg column to each other.

12. The table of claim 11 wherein the pair of draw bolts extend through the bottom leg column extension to secure the bottom leg column, the outer leg column and the foot casting together when the bottom leg column extension is positioned below the foot casting.

13. The table of claim 10 further comprising an adjustable leg column that extends through the outer leg column and the foot casting and is received in the bottom leg column extension when the bottom leg column extension is positioned below the foot casting, wherein the adjustable leg column is movable out of the outer leg column to move the table top.

14. The table of claim 13 further comprising an adjustment cylinder having a cylinder body and an extendable cylinder rod, wherein a bottom end of the cylinder body is received in the bottom leg column extension and a top end of the cylinder rod is coupled to the adjustable leg column.

15. The table of claim 10 wherein the bottom leg column extension is selectively removed in a first embodiment in which the height of the table top is fixed and utilized when the height of the table top is adjustable.

16. A method of forming a table leg for using in supporting a table top, the method comprising the steps of:

providing a foot casting that includes a pair of legs extending from a body portion;

attaching an outer leg column to the foot casting;

determining if the table leg is a fixed height table leg or an adjustable height table leg;

attaching a leg column extension to the body portion of the foot casting if the table leg is an adjustable height table leg;

connecting the foot casting and the outer leg column using a pair of draw bolts for the fixed height table leg and connecting the foot casting, the outer leg column and the bottom leg column with the pair of draw bolt for the adjustable height table leg.

17. The method of claim 16 further comprising the steps of:

inserting an adjustable leg column into the outer leg column and the foot casting, wherein the adjustable leg column is received in the bottom leg column extension when the bottom leg column extension is positioned below the foot casting, wherein the adjustable leg column is movable out of the outer leg column to move the table top.

18. The method of claim 16 wherein the foot casting, the outer leg column and the leg column extension have the same outer profile.

* * * * *